United States Patent [19]

Olofsson

[11] 3,941,520

[45] Mar. 2, 1976

[54] METHOD AND DEVICE FOR INJECTION OF LIQUID

[75] Inventor: Hans Kristoffer Olofsson, Huddinge, Sweden

[73] Assignee: Atlas Copco Aktiebolag, Huddinge, Sweden

[22] Filed: July 18, 1974

[21] Appl. No.: 489,941

[30] Foreign Application Priority Data

July 20, 1973 Sweden ..... 7310168

[52] U.S. Cl. ..... 418/9; 418/91; 418/97

[51] Int. Cl.[2]. F01C 21/06; F04C 29/04; F01C 1/16

[58] Field of Search ..... 418/9, 48, 55, 91, 94, 418/97–100, 164, 166, 201, 220

[56] References Cited

UNITED STATES PATENTS

| | | | |
|---|---|---|---|
| 2,290,137 | 7/1942 | Aldridge | 418/48 |
| 2,358,721 | 9/1944 | Ljungdahl | 418/100 |
| 2,695,694 | 11/1954 | Seinfeld | 418/91 |
| 3,343,526 | 9/1967 | Peras | 418/94 |

FOREIGN PATENTS OR APPLICATIONS

| | | | |
|---|---|---|---|
| 427,475 | 4/1935 | United Kingdom | 418/48 |

*Primary Examiner*—John J. Vrablik

*Attorney, Agent, or Firm*—Eric Y. Munson

[57] ABSTRACT

A method and a device for injecting liquid into a screw compressor is disclosed which allow the injected cooling liquid to move through the compressor in a pure axial movement. Through this a more even distribution of the liquid in the compression chambers is achieved resulting in improved cooling of the working medium.

9 Claims, 16 Drawing Figures

0°

180°

360°

540°

720°

V1

57
56
0°(720°)
V3

61(63)
V2
60(62)
V1
56

62(64)
57
56
V3
180°
61
V2
57

56
V4
57
62

METHOD AND DEVICE FOR INJECTION OF LIQUID

BACKGROUND OF THE INVENTION

The invention relates to a method and a device for injecting liquid in a screw compressor comprising a screw cam rotor and a screw thread rotor enclosing the screw cam rotor which rotors are rotatably journalled in a housing for rotation around mutually sideways displaced rotation axes and thereby form chambers for a working medium between their screw cam means and screw thread means which chambers during rotation move from a low pressure end to a high pressure end of the rotors while decreasing their volumes.

In such screw compressors of which suggestions are shown e.g. in Swedish patent specification No. 85,331 and U.S. Pat. specification Nos. 1,892,217 and 2,553,548 practical operation at high pressures and simultaneous cooling through liquid injection has not yet been realized.

SUMMARY OF THE INVENTION

The invention has as its purpose to create a method and a device for injecting cooling liquid in a screw compressor of the above mentioned type in which liquid injection as a pre-requisite for obtaining a high pressure level is realized such that the liquid droplets during their passage through the compressor are not exposed to disturbing accumulation caused by change of direction or centrifugal action. At the same time compression and letting out of the liquid carrying working medium should together be performed during several rounds of the screw cam rotor through which the available time for heat absorption is extended in a way which has not been possible before so that the number of revolutions can be chosen high.

BRIEF DESCRIPTION OF THE DRAWINGS

The invention is described more in detail in connection with the accompanying drawings in which.

DETAILED DESCRIPTION OF THE PREFERRED EMBODIMENT

Figure 1:
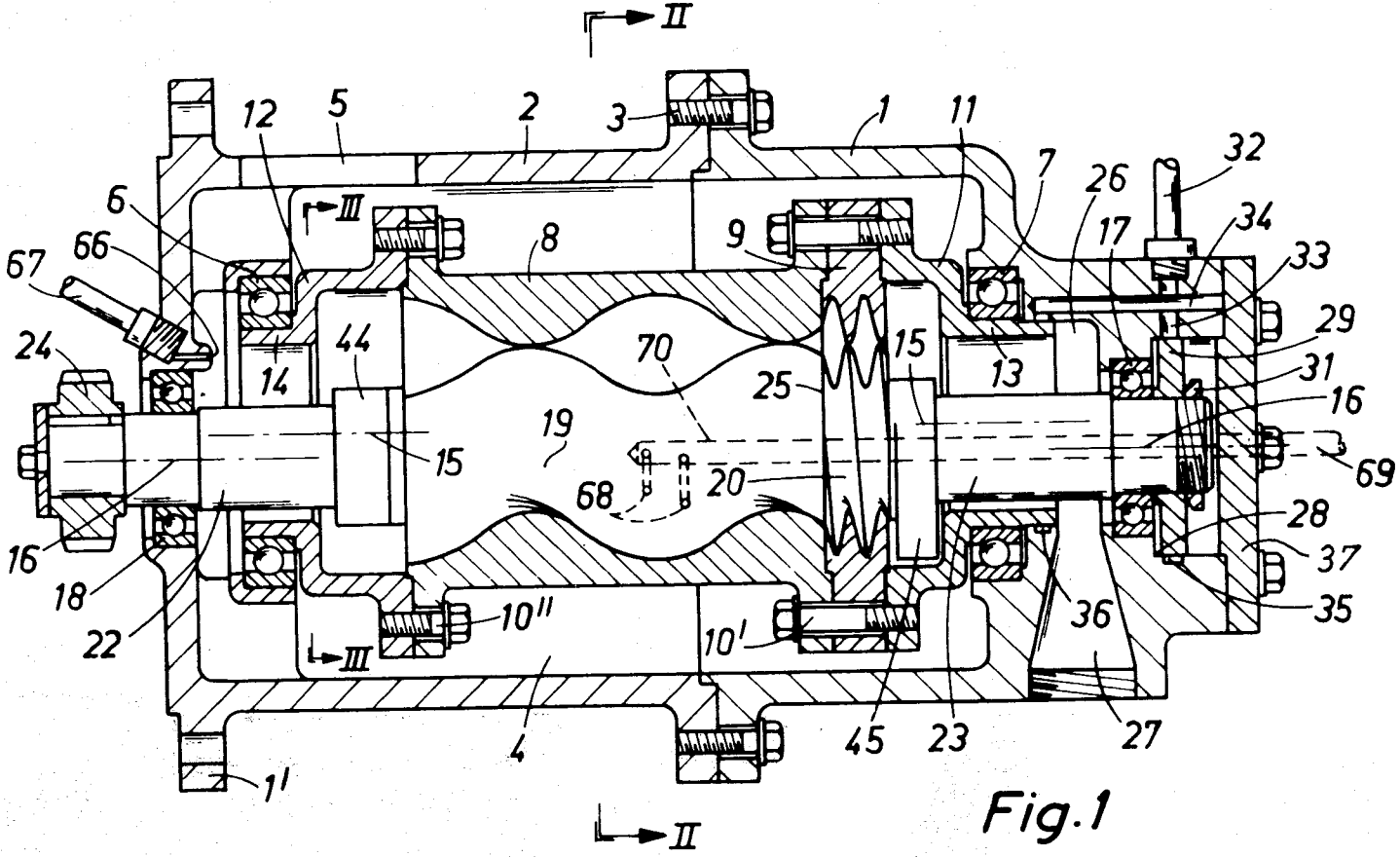
FIG. 1 shows a longitudinal section through a screw compressor according to the invention.

The screw compressor in the figures has a transversely divided housing 1, 2 which at flanges 1[1] are fastened to other components in a conventional compressor aggregate, not shown. The housing parts 1 and 2 are kept together by means of screws 3 and enclose a chamber 4 for the compressible working medium e.g. air. The air enters into the housing part 2 via an inlet opening 5 after it has passed a not shown filter. The housing parts 1, 2 carry in the chamber 4 coaxially arranged rolling bearings 6, 7. A gate or screw thread rotor provided with screw threads is divided transversely and comprises two mutually by means of screws 10[1] fixed hollow rotor parts 8, 9 which at their ends are fastened to end parts 11, 12. The end part 11 is fixed by the screws 10[1] and has a tubular neck of shaft 13 with a reduced diameter which is carried by the rolling bearing 7. The end part 12 is fixed by screws 10[11] to the rotor part 8 and has a similarly reduced neck of shaft 14 which is carried by the rolling bearing 6. Through this arrangement the screw thread rotor 8, 9 is journalled for rotation around a fix rotation axis 15 in the chamber 4.

Rolling bearings 17, 18 are arranged in the housing parts 1, 2, respectively and carry rotatably a screw cam rotor made with two axially after each other following cam rotor parts 19, 20 and which by means of gudgeons 22, 23 is introduced into the rolling bearings 17, 18 and rotates around a fix rotation axis 16 which is situated eccentrically at the distance a from and parallelly to the rotation axis 15. The screw cam rotor 19, 20 can if needed by dynamically balanced by means of eccentric weights 44, 45 which are freely rotatable in hollow spaces in the end parts 11, 12. The screw cam rotor 19, 20 is driven by an external motor, not shown, and gear change over a toothed wheel 24 which outside the housing part 2 is keyed to the gudgeon 22. As will be more closely described in the following, screw cam means on the cam rotor parts 19, 20 are during rotation in engagement with screw thread means in the hollow rotor parts 8, 9 so that the latter are driven around the axis 15 with a gear change depending on the chosen type of screw engagement. The working medium flows from the chamber 4 via the neck of shaft 14 and the end part 12 into the screw thread means of the screw thread rotor 8, 9. The screw cam means of the screw cam rotor 19, 20 cooperate with the screw thread means so that the working medium is compressed during its passage through the rotor parts 8 and 9. The compressed working medium enters into the end part 11 and continues via the neck of shaft 13 to a pressure chamber 26 in the housing part 1 from which it is carried off under pressure via a high pressure outlet 27.

The pressure chamber 26 is via the rolling bearing 17 open towards a cylindrical guidance 28 which is coaxial with the rotation axis 16 and rotatably carries a balancing piston 29. The piston 29 is by means of a nut 31 together with the inner race of the rolling bearing 17 fastened to the gudgeon 23. Oil under pressure is supplied from a suitable, not shown, pressure source in the compressor aggregate via a conduit 32 to channels 33, 34 in the housing part 1 of which the channel 33 emerges into a circumferential groove 35 around the piston 29 while the channel 34 emerges into a corresponding circumferential groove 36 around the neck of shaft 13 and coaxial with the rotation axis 15. The circumferential grooves 35, 36 form liquid pressure seals through which the pressure chamber 26 is sealed off in relation to the rotating rotor parts. The guidance 28 is covered by a cover 37 and provided with a not shown drainage channel outside the piston 29.

The screw cam means of the cam rotor part 19 comprises in the shown example a single-thread-screw which is circularly profiled with the radius R. The radius R is suitably chosen such in relation to the distance *a* between the rotor axes 15 and 16 that the relation *a*/R amounts to a value between 0.2 and 0.4. The cam rotor part 19 is given a wrap angle of approximately 720° and a lead which is defined by the condition that the length of the rotor should be 3–8 times the radius R. The cam rotor part 19 forms a right-hand thread if it is desired to drive the toothed wheel 24 counter-clockwise.

Figure 2:
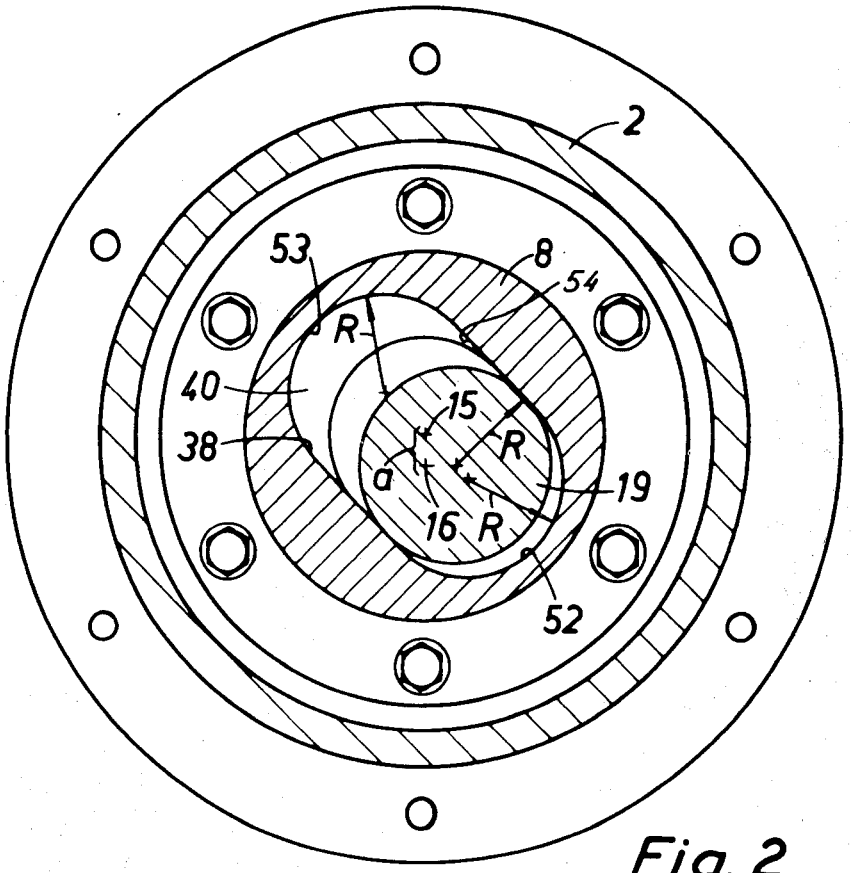
FIG. 2 is a cross section according to line II—II in FIG. 1.
Figure 3:
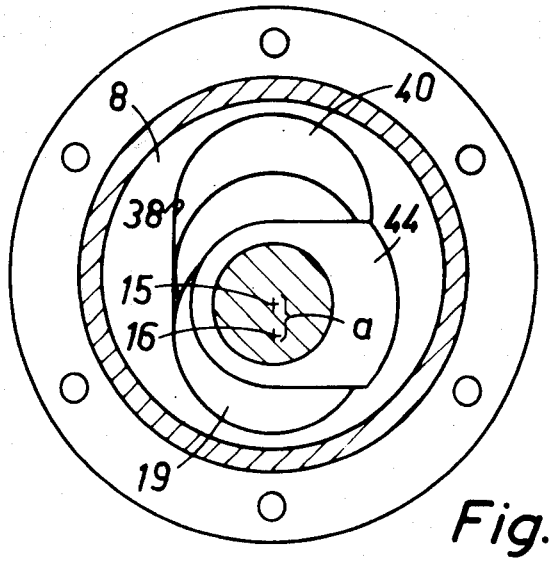
FIG. 3 is a cross section according to line III—III in FIG. 1.
Figures 4A, 4B, 4C, 4D, 4E:
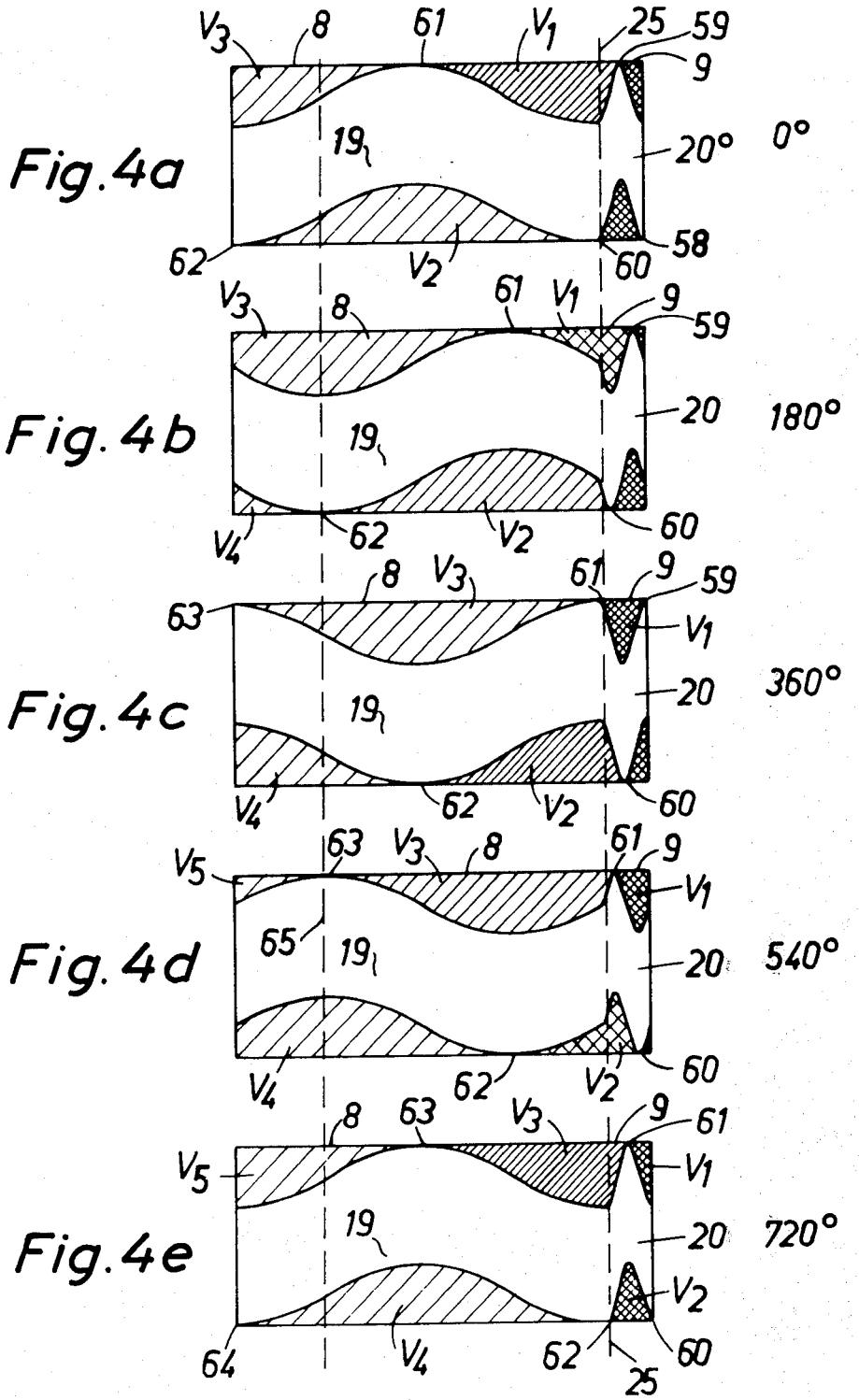
FIGS. 4*a* – 4*e* are plane expansions which schematically show side views of the helicoidal working chambers formed between the rotors during their rotation straightened out in one plane.

The hollow rotor part 8 of the screw thread rotor 8, 9, FIG. 2, has two for glidable cooperation with the cam rotor part 19 identically formed opposite screw threads 52, 53 which are half-circular and joined mutually through straight flanks 54 to a hollow profile enclosed by the contour line 38. The cooperation with the cam rotor part 19 requires a play of about 0.1 mm or less between the hollow profile 38 and the cam rotor part. The direction of the thread of the hollow profile 38 is the same as for the cam rotor part but the wrap angle is half as large i.e. approximately 360°. This means that the hollow rotor part 8 has double the lead of the cam rotor part 19 and when it is driven by the cam rotor part it will rotate with half the number of revolutions of the screw cam rotor 19, 20.

In compressor applications it is desirable to achieve inner compression of the working medium between the rotors before it is introduced into the pressure chamber 26. A continuously decreasing lead would make this possible but results in an undesirable complication of the manufacturing of the rotors. In order to avoid this the lead of the cam rotor part 19 is suddenly changed without changing the profile at a leap plane 25 which is transverse to the rotors so that the cam rotor part 20 is given an essentially smaller constant thread lead suitably between 2–10 times smaller lead. The cam rotor part 20 acting as a high pressure part is given a wrap angle of approximately 720°. The hollow rotor part 9 is made divided at the leap plane 25 in relation to the hollow rotor part 8 and its screw threads form a continuation of the screw threads 52, 53 but with a smaller constant lead which has been decreased in proportion to the cam rotor part 20 and with a wrap angle of approximately 360°. Through this arrangement the rotor parts 9, 20 will act as gates damming the working medium axially and which during the rotation of the rotors make inner compression of the working medium between the rotor parts 8 and 19 possible. This is illustrated more in detail in FIGS. 4*a* – 4*e* which for 0°, 180°, 360°, 540° and 720° turning of the screw cam rotor 19, 20 respectively show how the chambers $V_1$ – $V_5$ formed between the hollow rotor parts 8, 9 and the cam rotor parts 19, 20 move in the figures from the low pressure end towards the right in direction towards the high pressure end. In these figures the hollow rotor parts 8, 9 are, through a thought turning, straightened out to a plane expansion and represented by straight lines on opposite sides of the cam rotor parts 19, 20 which are straightened out in the same plane. Since the high pressure parts 9, 20 of the rotors have essentially smaller leads than the low pressure parts 8, 19 the tangent points representing the sealing lines 58 – 64 in FIGS. 4*a*–4*e* and which confine the working medium chambers $V_1$–$V_5$ axially will during rotation move axially at a slower rate in the high pressure parts than in the low pressure parts. The transverse sealing lines 59 – 64 will, therefore, be moved together axially from a value determined by the length of the low pressure rotor part 8 to a minimum value determined by the length of the high pressure rotor part 9 which with wrap angles according to the figures determines the inner compression of the rotors.

Figures 5A, 5B, 6A, 6B:
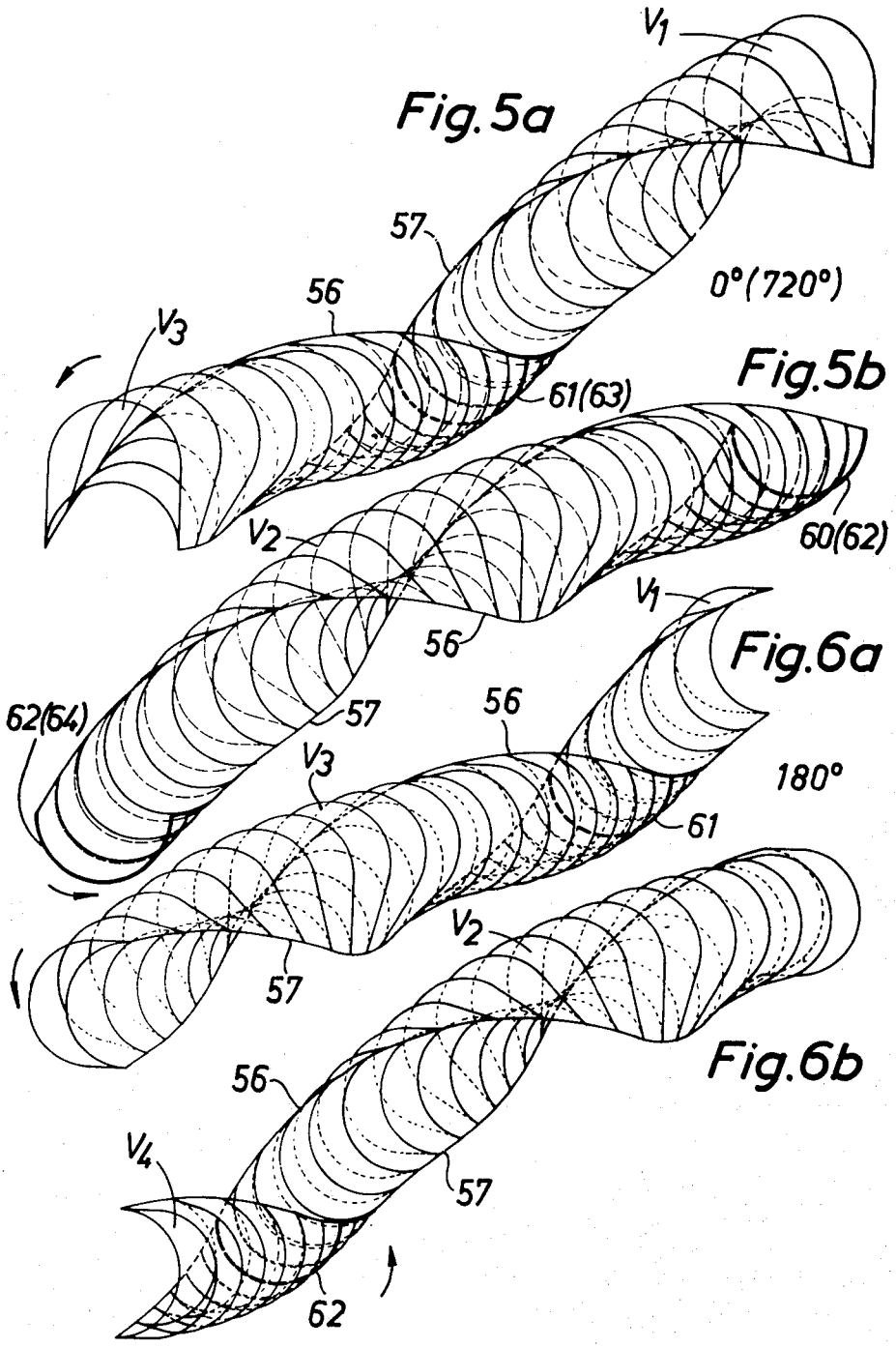
FIGS. 5*a* and 5*b* show the opposite rotor chambers in FIG. 4*a* (FIG. 4*e*) helicoidally in perspective when the rotors are in a position corresponding to FIG. 3.
FIGS. 6*a* and 6*b* show corresponding perspective pictures when the screw cam rotor has turned 180° and the screw thread rotor 90°.
Figures 7A, 7B, 8A, 8B:
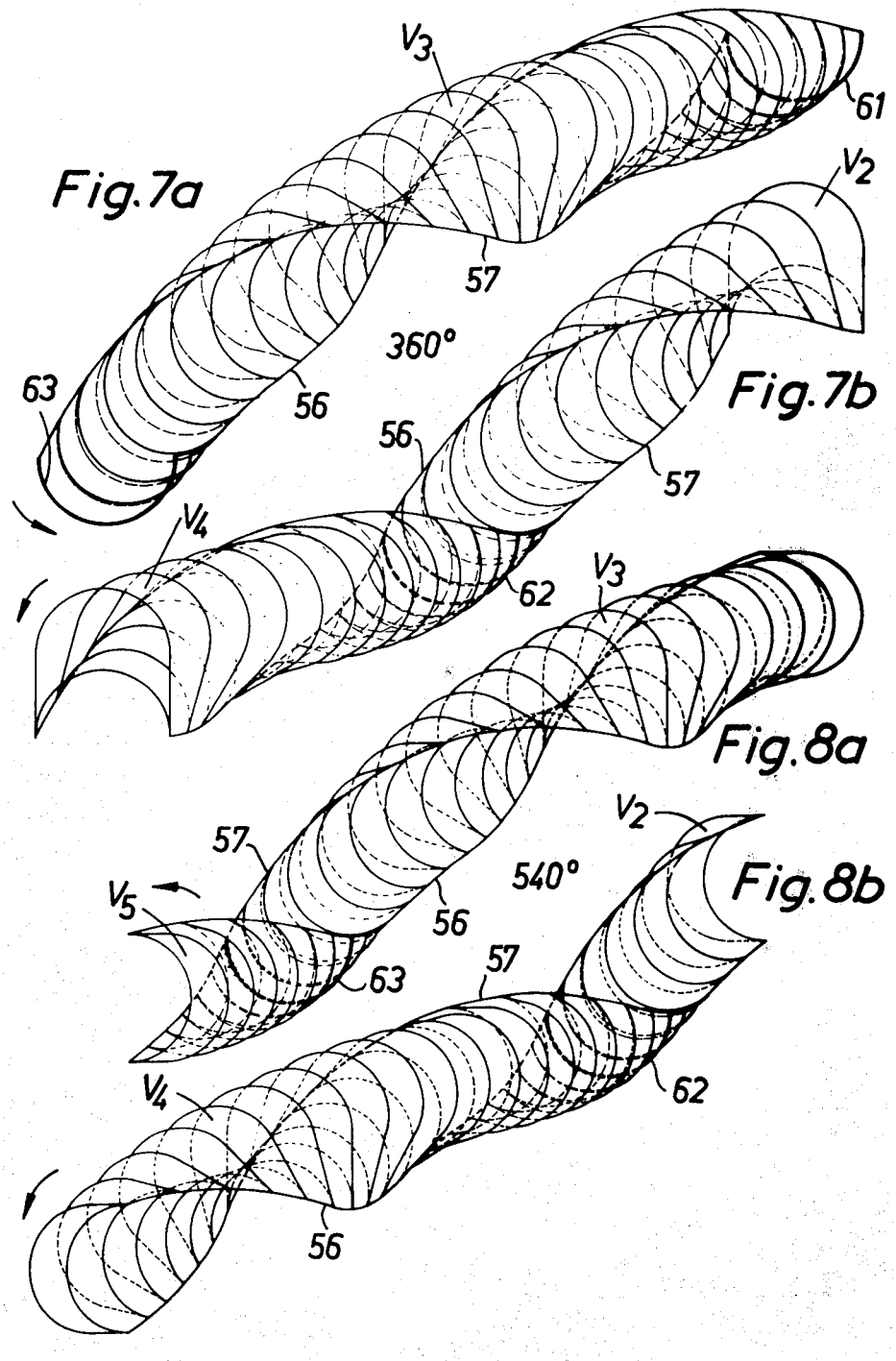
FIGS. 7*a* and 7*b* are corresponding perspective views where the respective rotors have turned 360° and 180°, respectively.
FIGS. 8*a* and 8*b* are corresponding perspective views of the chambers where the rotors have turned 540° and 270°, respectively.

In FIGS. 5*a*, 5*b* onwards to 8*a*, 8*b* the real shape of and movement of the working medium chambers $V_1$–$V_5$ within the low pressure parts 8, 19 of the rotors in correspondence to FIGS. 4*a*–4*e* respectively are illustrated. The axially strongly compressed but otherwise analogously helicoidally running high pressure rotor chambers have for better clearness been excluded. In FIGS. 5*a*, 5*b* and the subsequent figures the longitudinal sealing lines between the rotors have been designated 56 and 57. The axial movement of the transverse sealing lines 60 – 63 towards the high pressure side during the turning of the rotors is clearly shown. The working medium passes through and is compressed in the working chambers $V_1$–$V_5$ during a pure axial movement without change of direction i.e without rotation around the rotation axes 15, 16, FIG. 1, which because of the analogous build-up of the high pressure parts 9, 20 evidently also is valid for the passage of the working medium through these.

It is clear from FIGS. 4*a*–4*e* from the constantly axially moving engagement that the speed of the working medium at the inlet to the low pressure rotor parts 8, 19 is constant. In the same way it is clear that the speed at the outlet to the high pressure parts 9, 20 also is constant but of course essentially lower in proportion to the smaller lead.

Because of the high number of revolutions in the present embodiment which for the screw cam rotor can amount to 15,000 rpm and the high flow speed of the working medium resulting therefrom it is possible to decrease the length of the low pressure parts 8, 9 or their wrap angles so that compression in the working chambers $V_1$–$V_5$ can start before the following transverse sealing line 62, 63, 64 of respective chamber has been formed at the inlet of the rotor parts 8, 19, FIGS. 4*a*, 5*b* and 4*c*, 7*a*. This fact derives from the lag arising from the backwards propogation over the axial length of the low pressure parts of the compression wave created at the high pressure parts 9, 20 and gives a possibility to overload the working medium chambers $V_1$–$V_5$ with working medium before they are closed at the low pressure end. This is used through choosing the wrap angles of the low pressure parts approximately equal to 540° for the screw rotor part 19 and approximately equal to 270° for the hollow rotor part 8. This means a shortening of the screw rotor part 19 and the hollow rotor part 8 with 25 % with practically unchanged compressor capacity. This rotor shortening is illustrated in FIGS. 4*a* – 4*e* by the dotted line 65.

In order to improve the driving engagement and the sealing between the screw cam rotor 19, 20 and the screw thread rotor 8, 9 and for cooling the working medium during the compression liquid is injected into the working medium preferably oil in finely divided form. Oil can be injected into the neck of shaft 14 via a nozzle device 66 carried by the housing part 2 so that the interior of the screw thread rotor 8, 9 forms a receiver for the injected liquid. The nozzle device 66 is supplied with oil under pressure via a conduit 67 and is directed towards the interior of the screw thread rotor 8, 9 on that side of the rotation axis 15 which is opposite to the rotation axis 16 i.e. in line with the axial path of movement of the chambers $V_1$–$V_5$. While the screw cam rotor rotates a number of rounds the injected liquid cools the working medium in the chambers $V_1$–$V_5$ during their entire axial movement. The liquid or oil is carried by the compressed medium via the outlet 27 to a not shown conventional oil separator and an oil cooler which are incorporated in the compressor aggregate.

Alternatively the oil can be injected via a nozzle device 68 in form of one or more openings in the screw cam rotor 19, 20 to which oil is supplied via an oil channel 69 through the cover 37 and a rotatably but sealingly to the oil channel connected central axial rotor boring 70 through the parts 23, 20 and 19 of the screw cam rotor. Since the oil after the oil cooler can have a temperature of up to 50°, it is suitable to place the openings 68 in axial positions where a compression temperature exists between the rotors within the area for beginning compression in the chambers $V_1$–$V_5$ for the working medium which is close to the oil temperature.

It is clear from the above description that the liquid is injected into the interior screw threads 52, 53 of the screw thread rotor 8, 9 with the screw thread rotor as an envelope for the liquid carrying working medium whereby this as described in connection with FIGS. 5*a*, 5*b*, 8*a*, 8*b* is carried through the screw thread rotor 8, 9 axially essentially without change of direction and without rotation. Compression and letting out of the liquid carrying working medium in the screw thread rotor 8, 9 is carried out during several rounds of the screw cam rotor 19, 20, FIGS. 4*a* – 4*e*, through which an extended effective heat absorption is achieved by means of the liquid.

What I claim is:

1. A method for injecting cooling liquid in a screw compressor of the type including a screw cam rotor and a screw thread enclosing the screw cam rotor, which rotors are rotatably journalled in a housing for rotation around mutually sideways displaced rotation axes and thereby form chambers for a working medium between their screw cam and screw threads, which chambers during the rotation of the rotors move from a low pressure end to a high pressure end of the rotors while decreasing their volumes, without exposing the liquid droplets to accumulation caused by change of direction or centrifugal action in their passage through the compressor, comprising injecting cooling liquid continuously into the interior screw threads of the screw thread rotor utilizing the screw thread rotor as an envelope for the liquid carrying working medium, choosing a rotational speed ralationship between the rotors to eliminate the centrifugal action therein, passing the liquid carrying working medium through the screw thread rotor essentially axially without change of direction or rotation.

2. A method according to claim 1, wherein compression and letting out of the working medium is done in the screw thread rotor during several rounds of the screw cam rotor whereby an extended effective heat adsorption is achieved by means of the cooling liquid.

3. In a screw rotor machine for a compressible working medium including a screw cam rotor, a screw thread rotor enclosing the screw cam rotor, the screw cam rotor and screw thread rotor being rotatably journalled in a housing for respective rotation around parallel mutually displaced rotation axes, the rotors forming chambers for the working medium between their screw cam and screw threads which chambers move from a low pressure end to a high pressure end of the rotors during their rotation while decreasing their volumes, the improvement enabling improved cooling of the working medium by more even distribution of a cooling liquid comprising nozzle means for continuously injecting cooling liquid into the screw threads of the screw thread rotor, the screw thread rotor defining an envelope for the liquid carrying working medium, the screw threads having axially open ends, the rotors being journalled for rotation around stationary rotation axes and having a rotational speed relationship to eliminate the centrifugal action therein for obtaining an axial passage of the liquid carrying medium through the screw threads essentially without change of direction or rotation.

4. A screw compressor according to claim 3 wherein the cam rotor is a single-thread-screw while the screw thread rotor comprises a pair of oppositely situated and mutually connected screw threads enclosing the single-thread-screw to form the chambers therebetween.

5. A screw compressor according to claim 3 wherein the rotors at a leap plane transverse to the rotors are separated in a low pressure part and a high pressure part whereby the leads of the screw cam means and the screw thread means of the low pressure part at the leap plane suddenly are decreased to smaller leads in the high pressure part.

6. A screw compressor according to claim 3 wherein a nozzle device is arranged for injecting liquid into that area between the rotors which is situated on that side of the rotation axis of the screw thread rotor which is opposite to the rotation axis of the screw cam rotor.

7. A screw compressor according to claim 3 wherein the nozzle device is arranged in the housing and directed towards the axial inlet at the low pressure side of the screw thread rotor.

8. A screw compressor according to claim 3 wherein a nozzle device in form of one or more openings if formed in the screw cam rotor for injecting liquid into the area for beginning compression in the working medium chambers.

9. A screw compressor according to claim 3 wherein the total wrap angle from the low pressure end to the high pressure end of the screw thread means of the screw thread rotor amounts to such a value that compression and letting out of the liquid carrying working medium require several rounds of rotation of the screw cam rotor.

* * * * *